United States Patent [19]

Eppenbach

[11] 4,336,729

[45] Jun. 29, 1982

[54] COMPOSITE TOOL

[76] Inventor: Lawrence C. Eppenbach, 419 Kennedy St., Juneau, Ak. 99801

[21] Appl. No.: 174,883

[22] Filed: Aug. 4, 1980

[51] Int. Cl.[3] ..... B25B 23/00

[52] U.S. Cl. ..... 81/439; 81/90 C; 81/437

[58] Field of Search ..... 7/165, 106; 81/90 C, 81/90 D, 437, 439, 442, 461, 177 R, 177 E; 145/61 H, 61 J

[56] References Cited

U.S. PATENT DOCUMENTS

| | | | |
|---|---|---|---|
| 483,865 | 10/1892 | Potter et al. | 145/61 J |
| 673,056 | 4/1901 | Jacobs | 81/90 C |
| 761,523 | 5/1904 | Miller, Jr. | 81/90 C |
| 1,263,202 | 4/1918 | Brown | 81/90 C X |
| 1,384,705 | 7/1921 | Meyer | 81/90 C |
| 1,760,784 | 5/1930 | Skarke | 81/90 C |
| 1,882,462 | 10/1932 | Weber | 81/90 C |
| 2,389,954 | 11/1945 | Burns | 81/90 C X |
| 2,475,268 | 7/1949 | Wittle | 81/177 E X |
| 2,803,981 | 8/1957 | Stoecker | 81/90 C |
| 3,742,533 | 7/1973 | Brunette | 7/165 |

*Primary Examiner*—James G. Smith
*Attorney, Agent, or Firm*—Gordon L. Peterson

[57] ABSTRACT

A composite tool comprising two equal plastic half sections bonded to each other to form a tool body. The upper portion of the body defines a handle and the lower portion encloses a metallic channel assembly and two pin members reciprocally, slidably mounted within the channel assembly. Each of the pin members has a cylindrical section extending downwardly from the tool body. The tool of the present invention additionally comprises, at the end opposite the channel end, a blade assembly for use as a screwdriver or to remove a deck plate.

8 Claims, 5 Drawing Figures

COMPOSITE TOOL

BACKGROUND OF THE INVENTION

The present invention relates to a composite wrench-deck plate tool. More particularly, the invention relates to a composite tool which is easy and inexpensive to manufacture, which is particularly suited for use on boats and in which the wrench section can be adjusted to fit a wide-dimensional range of workpieces.

Wrenches which utilize two cylindrical pins to engage corresponding female holes or flanges on nautical fittings, flange unions, bungs and the like and to impart a torsional force on the workpiece to perform screwing and unscrewing operations have been described in the prior art. For example, U.S. Pat. No. 673,056 issued to Jacobs shows a wrench of this type. There have also been described wrenches of this type in which one of the two pins can be moved with respect to the other as to permit the wrench to be utilized on workpieces of various dimensions. For example, wrenches of this general description are shown in the following U.S. patents:

D. S. Miller, Jr. —U.S. Pat. No. 761,523; G. C. Brown—U.S. Pat. No. 1,263,202;

W. Meyer—U.S. Pat. No. 1,384,705; E. O. Skarke—U.S. Pat. No. 1,760,784;

C. A. Burns—U.S. Pat. No. 2,389,954; B. Stoecker—U.S. Pat. No. 2,803,981.

One problem with adjustable tools of this type is making them strong enough to withstand the substantial torsional loads which must be applied to a workpiece while, at the same time, reducing the weight of the tool so that it will float if it is dropped into the water. Of course, a relatively simple tool, such as this must be of relatively low cost.

It is also important to facilitate the adjustment of the pins so that the tool can easily accommodate workpieces of different sizes. Many of the prior art devices lock the pins in position with a nut or other similar device so that a wrench is required to adjust the spacing between the pins. This is undesirable in that a second tool is required to adjust the pin spacing.

SUMMARY OF THE INVENTION

This invention provides a composite tool which is strong, durable and lightweight. The tool may be made sufficiently light so that it floats in water. In addition, the composite tool is inexpensive and easy to manufacture. The composite tool is adapted for different purposes in that it may also carry a tool member adapted for other purposes, such as a screwdriver.

According to a preferred form of the present invention, a composite tool comprises two equal plastic half sections bonded to each other to form a tool body, the upper portion of said body defines a handle and the lower portion enclosing therein a metallic channel assembly and two pin members reciprocally slidably mounted within said channel assembly. Each of said pin members has a cylindrical section extending downwardly from the tool body. The tool of the present invention additionally comprises, at the end opposite the channel end, a blade assembly. The movement of the pin members in the channel assembly toward and away from each other is restrained only by friction. Accordingly, a second tool is not required to adjust the spacing between the pin members. Preferably, the surfaces of the channel assembly and pin members which slidably engage each other are coated with a low friction bearing material, such as polytetrafluoroethylene. By providing a slight interference fit between the channel assembly and the pin members, the pin members will remain in any set position during normal usage and handling of the composite tool, but can be easily manually adjusted so as to vary the spacing between the pin members.

The tool is made particularly strong by employing a structure which includes the tool body and the channel assembly. The channel assembly reinforces the tool body and mounts the pin members for movement toward and away from each other.

To provide a strong joint between the channel assembly and the tool body, the channel assembly includes at least a first channel having at least one shoulder projecting from the channel and received by a corresponding groove in the tool body. In a preferred construction, the channel assembly includes first and second channels spaced axially of each other, and the tool body includes a web between the first and second channels to more securely mount them. Each of the channels advantageously includes a web joining first and second legs, and the projection can advantageously take the form of an extension of the web.

To facilitate construction, the tool body advantageously includes first and second half sections integrally molded from a strong plastic material. The channel assembly is mounted between the half sections. In addition, the tool member, which may be a key or blade, is also mounted between the half sections. The half sections can be attached together in different ways, such as sonic welding and/or by locking members.

To reduce the weight of the composite tool, the tool body defines a sealed internal void space therein. Preferably, the void space is sufficient to make the composite tool sufficiently buoyant to float in water.

In a preferred construction, the tool body includes a shank which joins the handle to the second portion, i.e., the portion which retains the channel assembly. When the composite tool also includes the tool member, the tool member is mounted on the handle and preferably projects from the tool body in a direction opposite to the pin members. The second portion of the tool body is wider than the shank and can serve as a second handle for the composite tool and, in particular, a second handle for the tool member.

These and other features of the present invention will be better understood with reference to the accompanying drawing and to the detailed description thereof which follows:

DESCRIPTION OF THE PREFERRED EMBODIMENT

Figure 1:
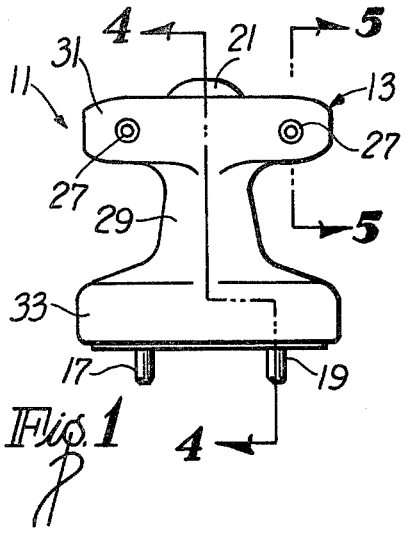
FIG. 1 is a front view of the composite tool of the present invention.
Figure 2:
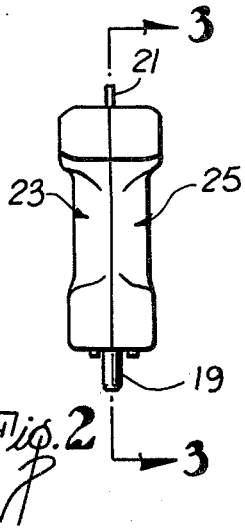
FIG. 2 is a side view of the same.
Figure 5:
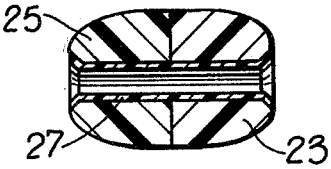
FIG. 5 is an enlarged detailed sectional view of the tool taken along line 5—5 of FIG. 1.

The drawing shows a composite tool 11 which generally includes a tool body 13, a channel assembly 15, pin members 17 and 19 slidable in the channel assembly and a tool member in the form of a key or blade 21. The tool body 13 includes identical half sections 23 and 25, each of which may be formed in an injection molding process from a high-impact plastic material, such as polycarbonate which, for added strength, may be reinforced by the incorporation of glass fibers or the like. The half sections are joined together, for example, by sonic welding and/or tubular members which in the illustrated embodiment are locking pins or rivets 27 (FIGS. 1 and 5).

The tool body 13 includes a shank 29, and handles 31 and 33 which are integrally joined by the shank 29 and which are wider than the shank and project outwardly therefrom in spaced apart relationship. This configuration, in addition to providing sufficient space for mounting the channel assembly 15 and the blade 21, provides the user with suitable gripable handles when the tool is used, either as a wrench or to rotate a member such as a deck plate or a screw.

Figure 3:
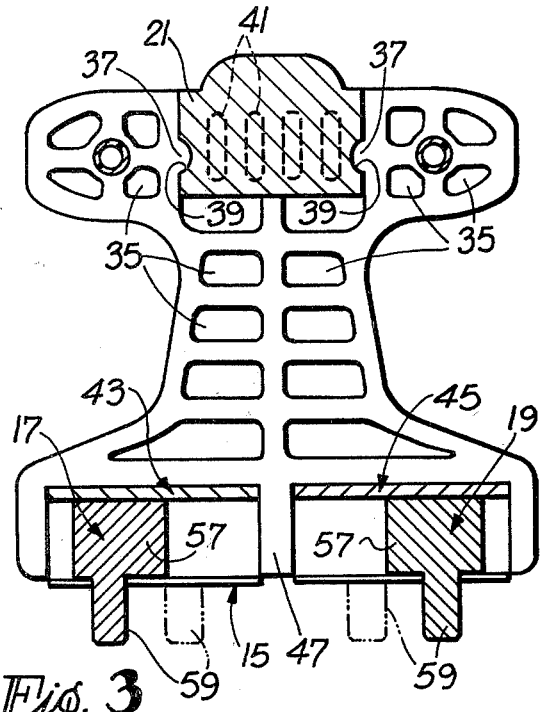
FIG. 3 is an enlarged sectional view of the tool taken along line 3—3 of FIG. 2.
Figure 4:
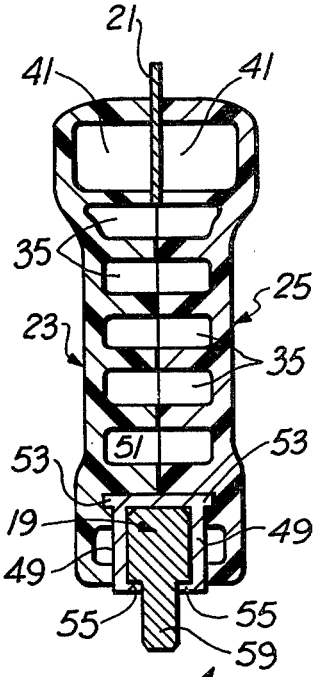
FIG. 4 is an enlarged sectional view of the tool taken along line 4—4 of FIG. 1.

The half sections 23 and 25 are provided, on the side where the two sections are joined to each other, with a plurality of open cavities 35, clearly visible in FIGS. 3 and 4, which with the two sections joined, mate with each other to form sealed air chambers or void space (see FIG. 4). The purpose of such cavities 35 is multifold. In the first place, they will result in a more economical tool since the amount of plastic material necessary to fabricate the tool is reduced. Secondly, the resulting tool will be much lighter in weight and thus easier to handle. Finally, the sealed air pockets defined by the cavities 35 give the tool the ability to float so that it will remain on the surface it it is accidentally dropped into the water and can thus be easily recovered.

The blade 21 is secured in place by two plastic ears 37, integral with the inner surface of the half sections 23 and 25, which engage corresponding notches 39 located on the lateral edges of the blade. Additional stability and strength is provided by a plurality of plastic lugs 41 (shown in dashed lines in FIG. 3), integral with the inner surface of the half sections 23 and 25. Such lugs 41, a total of eight in the present embodiment, extend from both inner surfaces of the half sections into tight abutting relationship with both sides of the blade 21, thus insuring the stability thereof.

The channel assembly 15 includes channels 43 and 45 constructed from a strong material which is preferably different from the material forming the tool body 13. For example, the channels 43 are preferably constructed from a suitable metal, such as anodized aluminum, and they may be extruded.

In the present embodiment, two separate channels 43 and 45 linearly disposed with respect to each other are provided. While this arrangement is preferred since it provides the maximum resistance to torsional stresses and it provides an additional web 47 of the sections 23 and 25 for retention of the channels, it is evident to one skilled in the art that a single unitary channel could be used for both pins without in any way departing from the present teachings.

Each of the channels 43 and 45 comprises a pair of legs 49 integrally joined by a web 51. The shoulders 53 projecting laterally of the channel as an integral extension of the web 51. The shoulders 53 are received in corresponding grooves of the half sections 23 and 25, respectively, with the channels 43 and 45 being positioned between the two half sections. Each of the channels 43 and 45 also includes in-turned flanges 55 at the free ends of the legs 49 for retaining the associated pin member. Providing of the channels 43 and 45 between the two half sections 23 and 25 facilitates construction and assembly. The interlock between the shoulders 53 and the half sections 23 and 25 strengthens the tool 11 against torsional forces encountered during use. In addition, the shoulders 53 impart additional torsional resistance to the channels 43 and 45.

Each of the pins 17 and 19 consist of an upper or enlarged sliding section 57 having a substantially rectangular or square cross-section and an integral cylindrical section 59 which extends outside the channel and which is adapted to engage the workpiece. The channels 43 and 45 have an internal reverse U-shaped cross section only slightly larger than the outer dimensions of the sliding section of the pins.

Both pins and channels may be constructed of hard anodized aluminum or similar metal in order to withstand the torsional stresses exerted thereupon when the tool is used. The surfaces of the channels and of the pins which come in contact during the sliding operation are preferably coated with a low-friction material, such as polytetrafluoroethylene. This coating, in addition to minimizing wear and facilitating the sliding of said pins within said channels, serves to provide an interference or friction fit between the pins and the channels, thus preventing the pins from accidentally moving from their desired position by reason of gravity or during the handling of the tool. The positions of the pins can be changed, however, merely by applying thereto sufficient manual pressure.

To assemble the tool, the key or blade 21, the channels 43 and 45 and the pin members 17 and 19 are positioned between the two plastic half sections which are then welded to each other sonically or by any other standard plastic welding procedure. In order to provide additional strength, the two halves are further secured to each other by the two tubular pins or rivets 27 positioned in the wrench handle section 31 of the tool, as shown in FIGS. 1, 3 and 5.

A tool of the type contemplated by the present invention may be suitable for most common applications by providing, for example, a range of movement of the pin members of from about 1 to about 2.625 inches, measured between the center lines of said pins. In a preferred form of the invention, a slip-proof finish is provided on the outer surface of the tool, either by providing thereon a rough surface during the molding operation or by chemical or mechanical treatment of the surface after said operation. The composite tool 11 can be used as a wrench by inserting the projecting cylindrical sections 59 into a plate or other member to be turned and utilizing the handle 31 to apply a torque to the composite tool. Similarly, by inserting the blade 21 into a slot of a screw or deck plate (not shown) and using the handle 33, torque can be applied to the screw or deck plate.

While the invention has been described in detail, it is obvious to one skilled in the art that various variations and modifications can be made in the light of the instant disclosure without departing from the scope thereof. All said variations and modifications shall be considered as falling within the ambit of the present invention.

I claim:

1. A composite tool comprising:

first and second half sections of plastic material;

means for attaching said half sections to each other to form a tool body, a first portion of said tool body defining a handle;

a channel assembly mounted within a second portion of said tool body and spaced from said handle portion;

first and second pin members mounted within said channel assembly for movement toward and away from each other;

each of said pin members having a workpiece engaging section extending from the tool body and adapted to engage a workpiece and apply torque thereto; and said channel assembly including a first channel having at least one of said pin members mounted therein, said first channel including at least one shoulder projecting from said channel and received by a corresponding groove in at least one of said half sections to thereby at least assist in mounting said first channel on said tool body.

2. A composite tool as defined in claim 1 wherein said tool body defines sufficient essentially sealed interior void space therein to make the composite tool sufficiently buoyant to float in water.

3. A composite tool as defined in claim 1 wherein said tool body includes a shank joining said handle to said second portion, said second portion and said handle being wider than said shank, and said composite tool includes a tool member carried by said handle between said half sections and projecting outwardly of said handle, said second portion of said tool body defining a second handle for said composite tool.

4. A composite tool as defined in claim 1 wherein said channel assembly is constructed of metal and said plastic material is high-impact polycarbonate.

5. A composite tool as defined in claim 1 wherein said attaching means includes at least one tubular member in said handle.

6. A composite tool as defined in claim 1 wherein said channel assembly includes a second channel within said tool body, said second channel being spaced axially from said first channel, said tool body including a web intermediate said first and second channels for assisting in mounting said first and second channels on said tool body, and said second channel having at least one of the pin members mounted therein.

7. A composite tool comprising:

first and second half sections of plastic material;

means for attaching said half sections to each other to form a tool body, a first portion of said tool body defining a handle;

a channel assembly mounted within a second portion of said tool body and spaced from said handle portion;

first and second pin members mounted within said channel assembly for movement toward and away from each other;

each of said pin members having a workpiece engaging section extending from the tool body and adapted to engage a workpiece and apply torque thereto; and said channel assembly including first and second metal channels separated axially of each other and located between said half sections, said first and second channels having the first and second pin members slidably mounted therein, respectively, each of said first and second channels including first and second legs integrally joined by a web and a pair of shoulders projecting from the channel adjacent the junctures of the legs and web, said half sections having grooves for receiving said shoulders to thereby assist in mounting said first and second channels on said tool body.

8. A composite tool as defined in claim 7 wherein said first and second pin members are slidable within said first and second channels, respectively, the surfaces of the first and second channels and the surfaces of the first and second pin members which are in sliding contact are coated with a relatively low friction bearing material, said tool body defines an essentially sealed void space therein which is sufficient to make the composite tool sufficiently buoyant to float in water, said tool body has a shank for joining said handle to said second portion of said tool body, a tool member mounted between said half sections at said handle and projecting outwardly of said handle, said handle and said second portion of said tool body being wider than said shank whereby said second portion of said tool body defines a second handle for said tool.

* * * * *